US006823908B2

(12) United States Patent
Hsu

(10) Patent No.: US 6,823,908 B2
(45) Date of Patent: Nov. 30, 2004

(54) METHOD FOR FORMING BAMBOO SLATS OF WINDOW BLINDS

(76) Inventor: Angela S. H. Hsu, 235 Chung-Ho, Box 8-24, Taipei (TW)

( * ) Notice: Subject to any disclaimer, the term of this patent is extended or adjusted under 35 U.S.C. 154(b) by 331 days.

(21) Appl. No.: 10/039,913

(22) Filed: Oct. 25, 2001

(65) Prior Publication Data

US 2003/0079804 A1 May 1, 2003

(51) Int. Cl.[7] ..... B27D 1/00

(52) U.S. Cl. ..... 144/350; 144/347; 144/348; 144/380; 428/106; 428/537.1; 428/17; 156/62.4; 156/250; 156/296

(58) Field of Search ..... 144/329, 346, 144/347, 350, 348, 364, 380; 428/105, 106, 17, 537.1; 52/745.19; 160/168.1 R, 176.1 R; 156/61, 62.4, 250, 296

(56) References Cited

U.S. PATENT DOCUMENTS 5,896,903 A * 4/1999 Chen et al. ..... 144/350
5,967,207 A * 10/1999 Chen ..... 144/380
5,972,467 A * 10/1999 Washo ..... 144/380
6,098,680 A * 8/2000 Nien ..... 144/380
6,192,949 B1 * 2/2001 Nien ..... 144/350
6,321,803 B1 * 11/2001 Nien ..... 144/380

* cited by examiner

*Primary Examiner*—W. Donald Bray

(57) ABSTRACT

A method for manufacturing bamboo stats uses high quality window blinds. The method comprises the steps of slicing and smoothing, streaming and boiling, drying, further smoothing, assembling, and cutting. Through a refinement process with chemical substances, the bamboo slats can be a pressure-resistant, moisture-proof, and insects-proof product. The processed bamboo slats are manufactured by an integrated operation of mass production so as to form a high quality bamboo window curtains with a lower cost.

1 Claim, 8 Drawing Sheets

METHOD FOR FORMING BAMBOO SLATS OF WINDOW BLINDS

BACKGROUND OF THE INVENTION

FIELD OF THE INVENTION

The present invention relates to window blinds, and particularly to a window blind made of bamboo slats which are processed by a lower cost and a high efficiency process.

Particularly, the present invention relates to a window blind made of high quality bamboo slats through a refinement process with chemical substances and is an efficient process so that they can be pressure-resistant, moisture-proof, and insects-proof. The bamboo slats are sliced into desired shapes and putting them together. The method of the present invention is easier than that of conventional window blinds made of bamboo slats. Moreover, the cost is greatly reduced and the yield rate is increased effectively.

SUMMARY OF THE INVENTION

Accordingly, the primary object of the present invention is to provide method of manufacturing bamboo slats of bamboo blinds comprising the steps of: slicing bamboos into 7 to 12 pieces of bamboo strips, each having a width of 18–27 mm, then peeling off barks and joints of the bamboo and smoothing the bamboo strips so that each of the bamboo strips has a thickness from 6 mm to 8 mm and a width of 16 mm to 24 mm; steaming the bamboo strips in a container with high pressure and high heat through 10–120 minutes for removing sugars contained in the bamboo strips: then boiling them in a boiler filled with water with 0.3%–0.8% of NaOH for a predetermined time period, and then taking the bamboo strips out of the boiler and washing the bamboo strips; then, putting the bamboo strips into the boiler with solution of anti-insects boride and bleach detergent and boiling the bamboo strips through 2–5 hours; drying the steamed and boiled bamboo strips at a temperature of about 40–60° C. and making sure that the water in the bamboo strips is effectively reduced to be between 5–10% and the hardness of the bamboo strips is upgraded as well; smoothing the dried bamboo strips on the whole surface for forming oblong bamboo strips having a thickness of about 4.5–7 mm and a width of about 15–21 mm; assembling a plurality of smoothed bamboo strips into a bamboo plate having a thickness of about 4.5–7 m/m and then sanding the two sides of the bamboo plates; then, applying adhesive to gaps between the bamboo plates and pressing the bamboo plate in a pressing machine under high temperature and high heat so as to form a multi-layer bamboo plate set having the thickness of 15–45 mm; and cutting vertically the multi-layer bamboo plate set into bamboo slats of a predetermined size with a thickness of 3 mm and then performing the processes of anti-moisture and anti-insects polish or wax to surfaces of the bamboo slats.

DETAILED DESCRIPTION OF THE INVENTION

Figure 1:
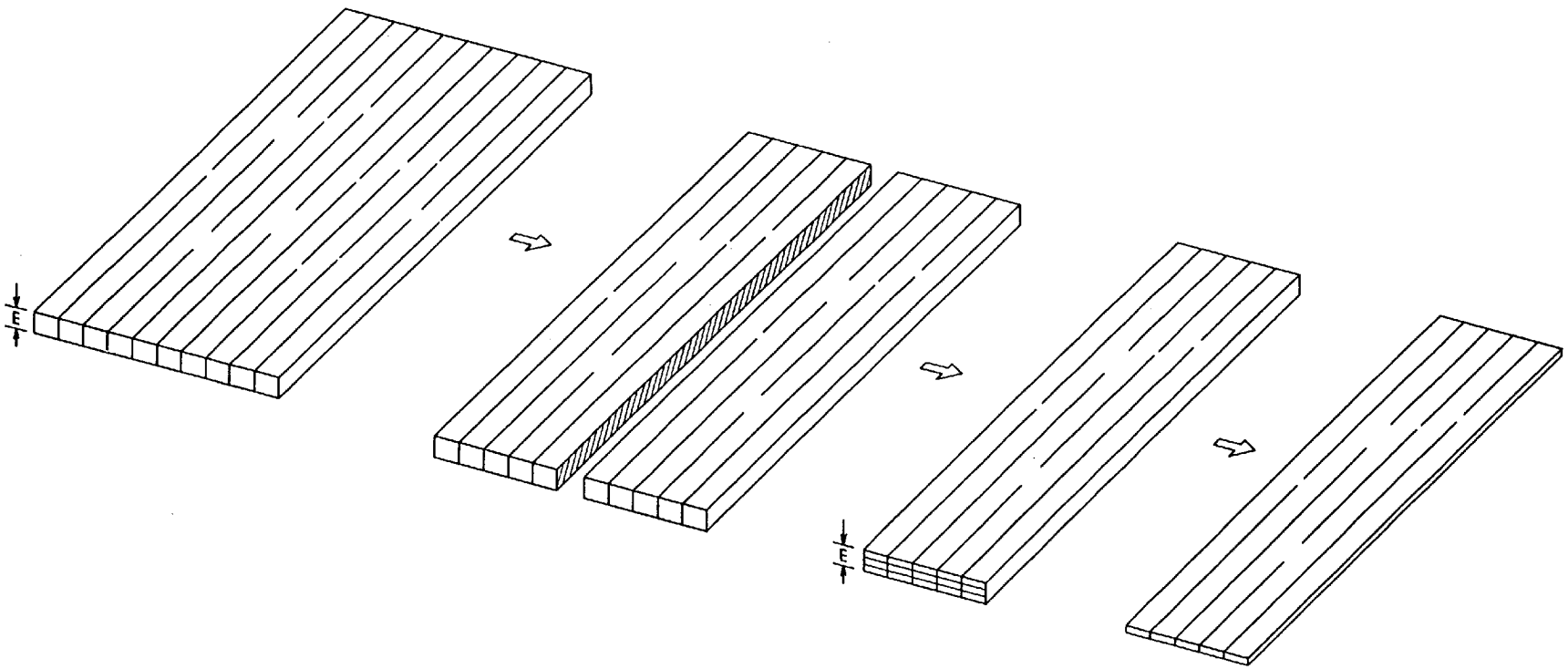
FIG. 1 PRIOR ART
FIG. 1 is a perspective view of a prior art process for slicing the glued bamboo slats into predetermined sizes.
Figure 2:
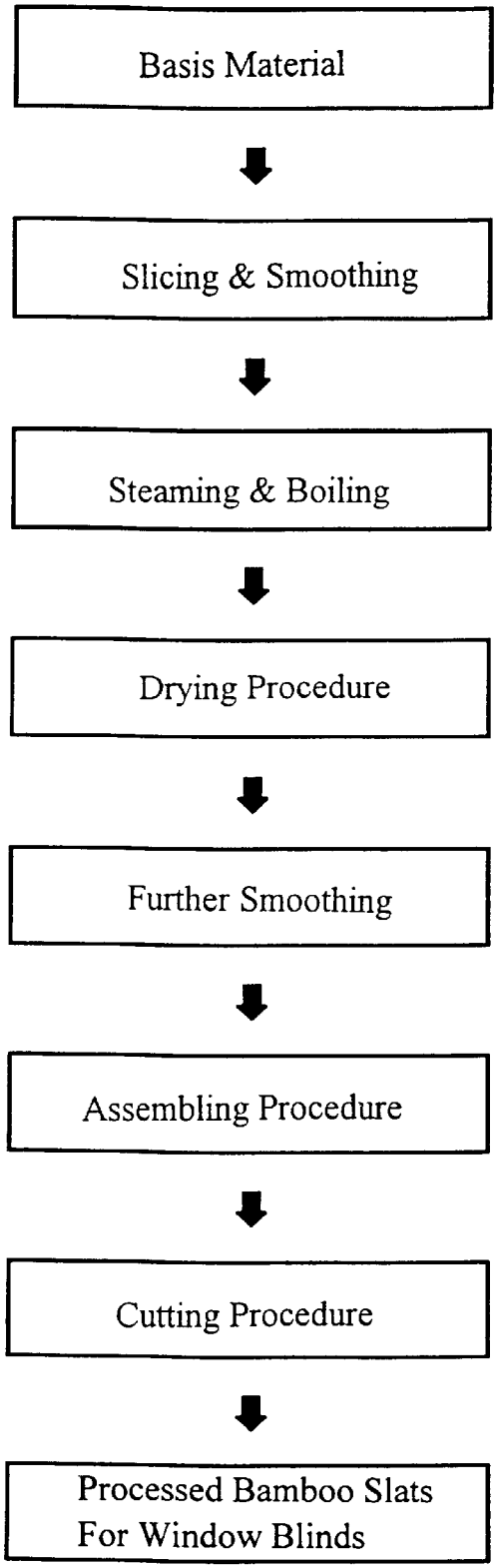
FIG. 2 is a flow chart of manufacturing bamboo slats of the invention.

The method of manufacturing a window blinds by using bamboo slats of the present invention, as shown in FIG. 2, is to select the 6-year-old bamboos and slice them into strips of a desired length (i.e., 1050 m/m, 2000 m/m or 2600 m/m) as a basis material.

Figure 3:
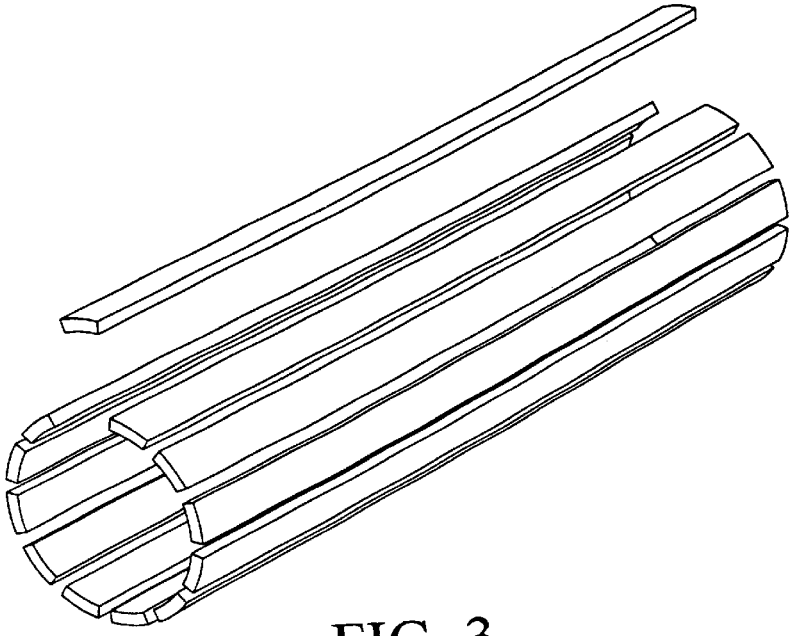
FIG. 3 is a perspective view of the sliced bamboo strips of the present invention.
Figure 4:
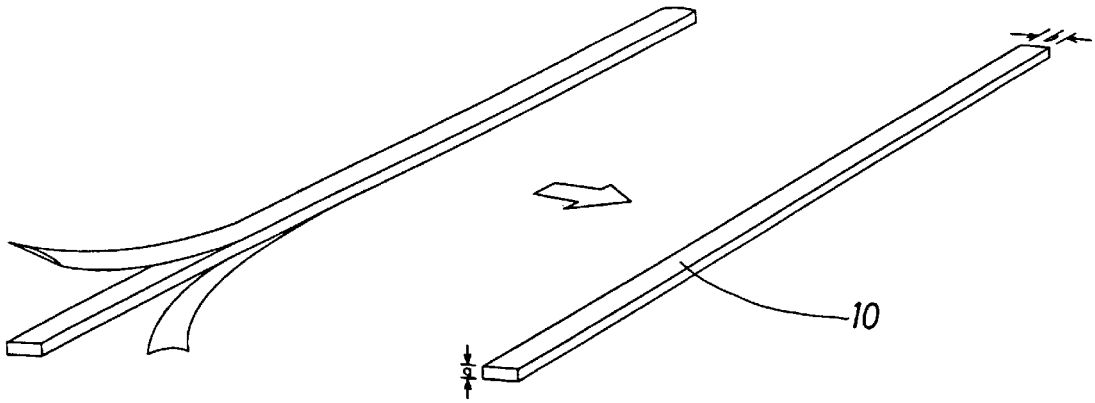
FIG. 4 is a perspective view showing the bamboo strips being peeled off their bark and membrane according to the process of the present invention.
Figure 5:
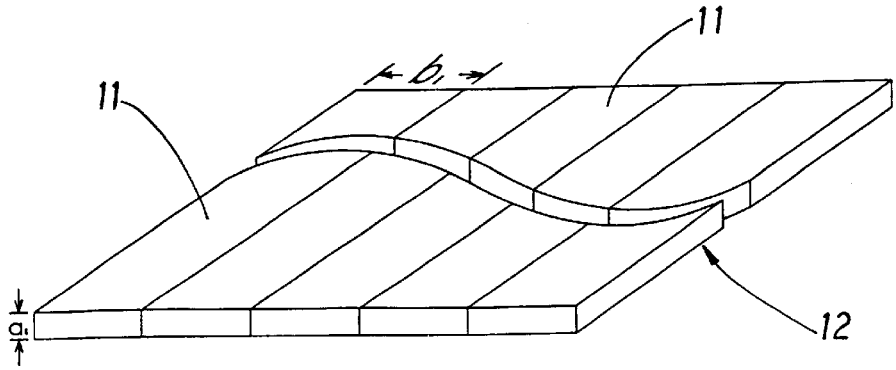
FIG. 5 is a perspective view showing the smoothed bamboo strips being horizontally assembled into a single and large piece of bamboo plate set according to the process of the present invention.

The manufacture method of the present invention includes the following steps:

(I) Slicing and Smoothing:, As shown in FIGS. 3 and 4, the bamboos are sliced into 7 to 12 pieces of small strips, each having a width of 18 mm–27 mm. Then the bark and membrane of the strips are peeled and smoothed to make each of strips (10) have a thickness of 6–8 mm and a width of 16 mm–24 mm (II) Streaming and Boiling:—The smoothened strips is placed in a container with high pressure and high heat stream therein through 10–120 minutes in order to get rid of sugar contained in the bamboo strips. Then the strips is placed in a boiler filled with water with 0.3–0.8% of NaOH to boil for a time period. Then, the bamboo strips are taken out of the boiler and washed. Then, the bamboo strips are moved back to the boiler with solution of anti-insects boride and bleach detergent to boil for 2–5 hours.

(III) Drying: The streamed and boiled bamboo strips are dried by wind at a temperatures of about 40–60° C. and to make sure that the water contained in the bamboo strips will be effectively reduced to be between 5–10% and their hardness will be upgraded as well.

(IV) Paring: The bamboo strips are sufficiently pared on the whole surfaces so that each bamboo strip has an oblong bamboo strip having a thickness of about 4.5 mm–7 mm and a width of about 15 mm–21 mm.

Figure 6:
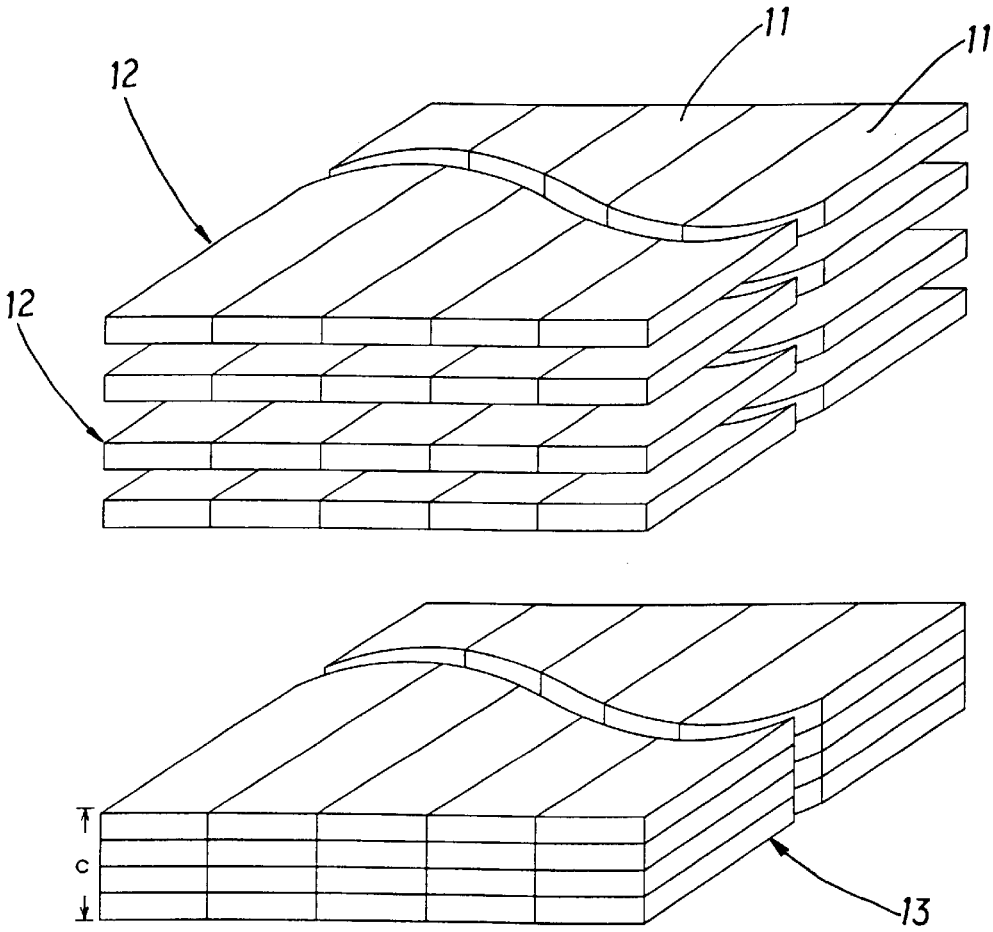
FIG. 6 is a perspective view showing the bamboo plates being heatedly pressed by a hydraulic press into a multi-layer bamboo plate according to the process of the present invention.

(V) Assemblying: A plurality of smoothed bamboo strips are horizontally arranged and are assembled to a predetermined size (11) so as to be formed as a single piece of bamboo plate (12). The bamboo plate having a thickness of about 4.5 mm–7 mm, and then to sand the two sides of the bamboo plate (12). Then, adhesive is applied to the gaps between the bamboo plates and then the bamboo plate is pressed in a pressing machine under high temperature and high heat into a multi-layer (i.e., 3–15 layers) bamboo plate set (13) (see FIG. 6). Preferably, the bamboo plat set has a thickness of 15 mm–45 mm.

Figure 7:
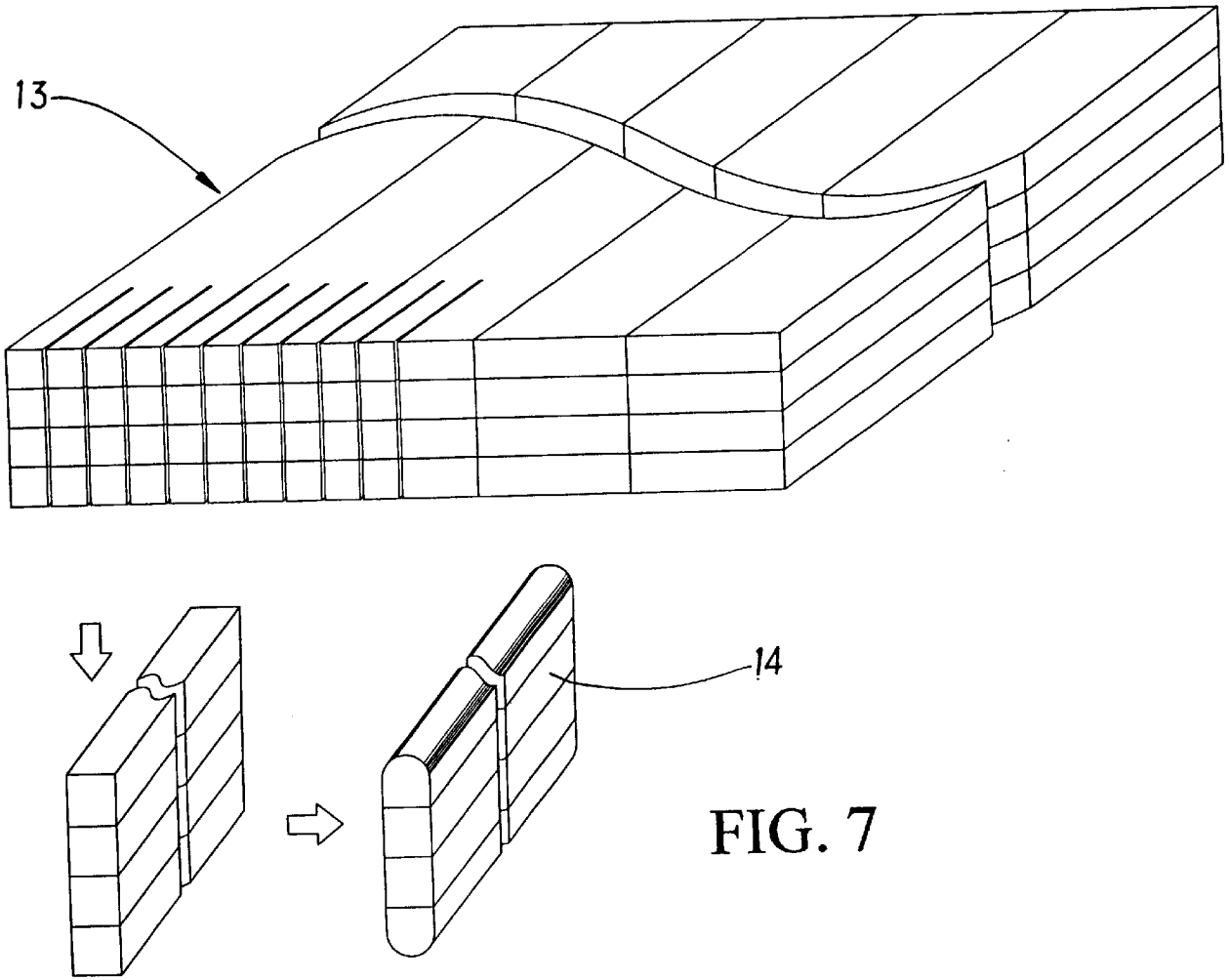
FIG. 7 is a perspective view showing the multi-layer bamboo plates being cut into pieces of window blinds leaves.

(VI) Cutting bamboo plate set: The multi-layer bamboo plate set (13) is longitudinally cut into bamboo slats of predetermined size with a thickness of 3 mm(14). Then processes of anti-moisture, anti-insects polish, and sand or wax process are applied to the surface of the bamboo slat so that a piece of the processed bamboo slat is formed (as shown in FIG. 7).

Figure 8:
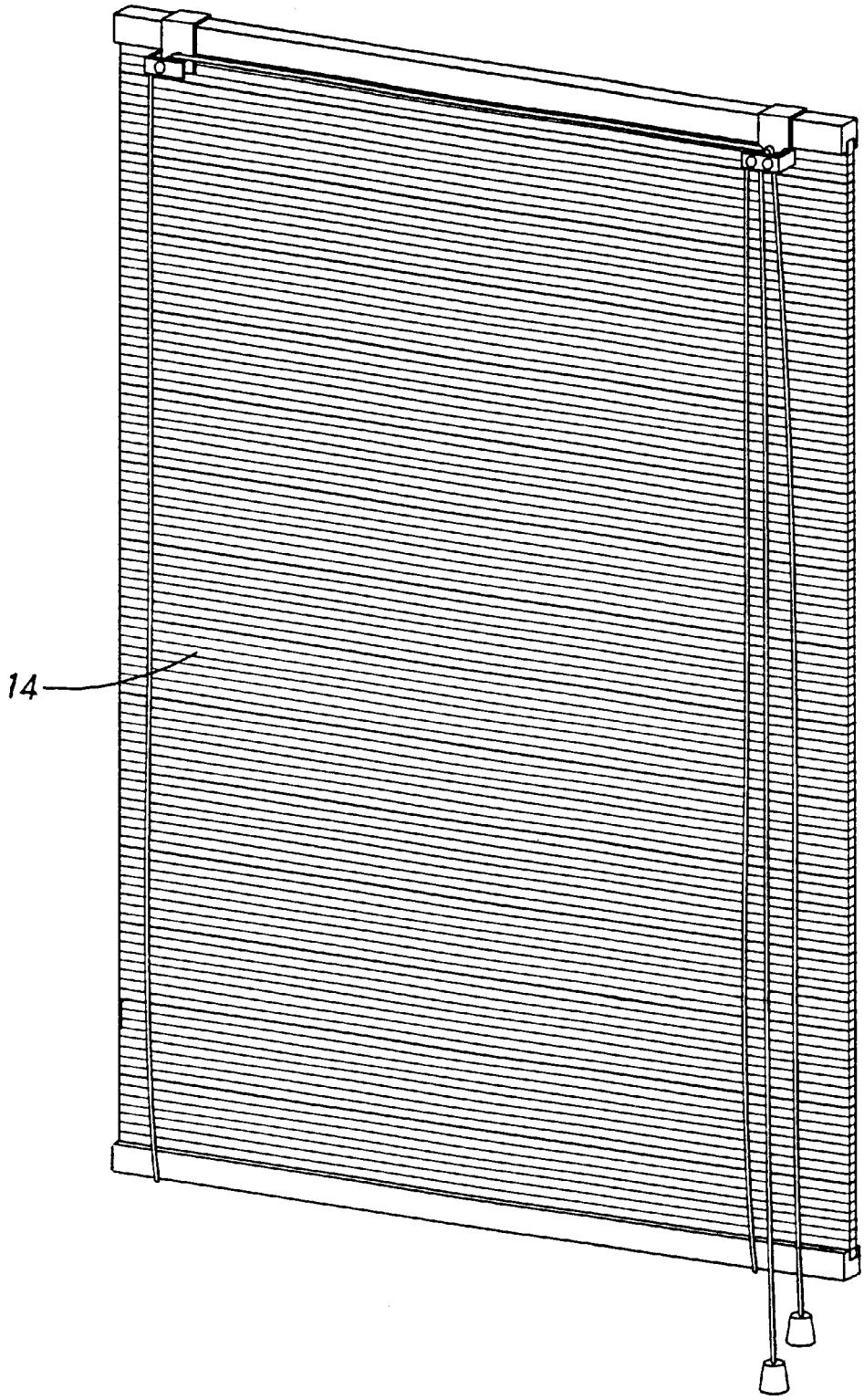
FIG. 8 is a perspective view showing a window blinds made of the processed bamboo slats according to the process of the present invention.
Figure 9:
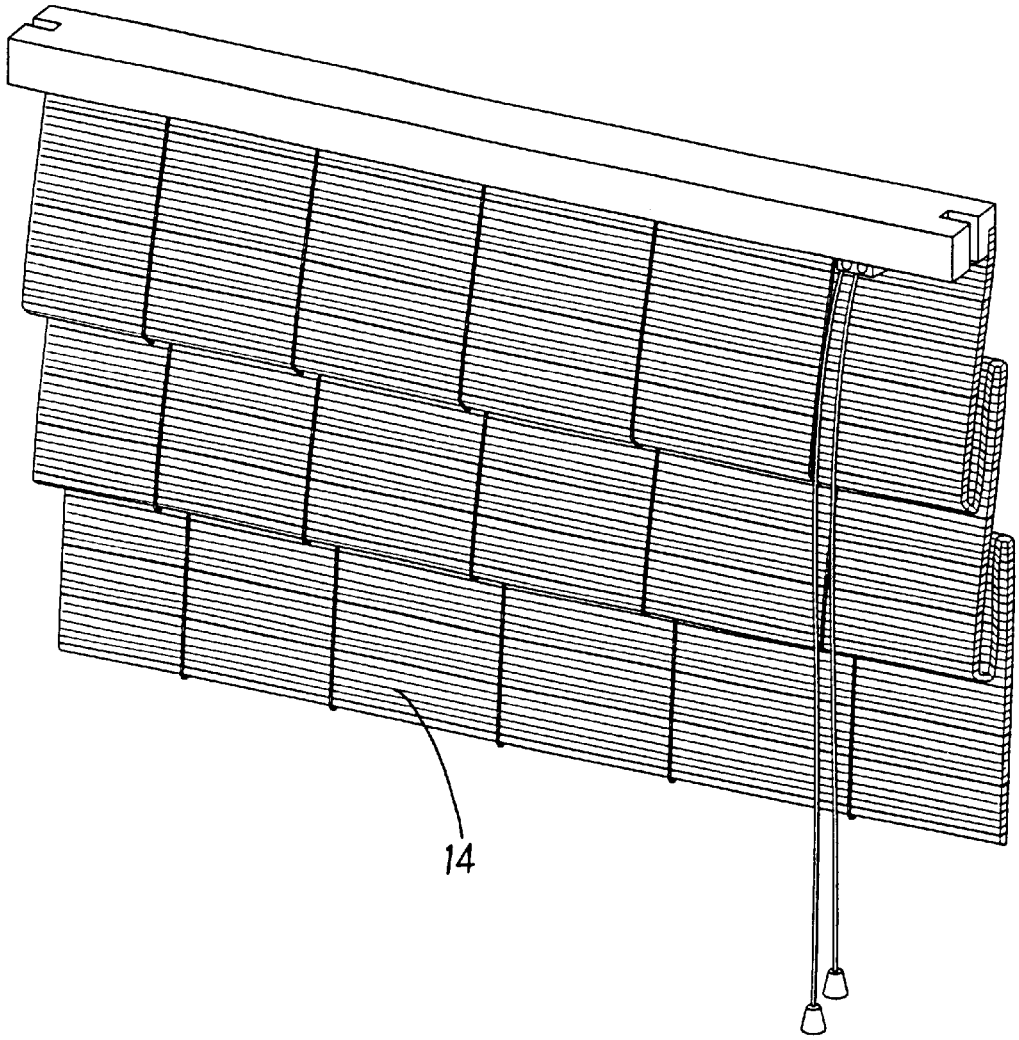
FIG. 9 is a perspective view of a Roman Shade made of the processed bamboo slats of the invention.

Referring to FIGS. 8 and 9, it is shown that roll-up blinds 14 (in FIG. 8) and Roman shades (14 in FIG. 9) made of the bamboo slats of the invention have preferred better pressure-resistance and stronger hardness.

Figure 10:
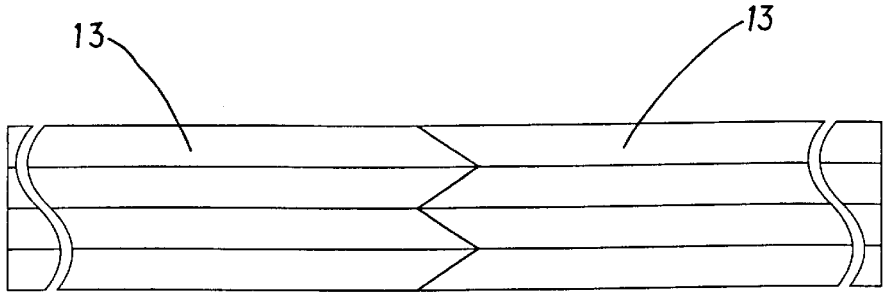
FIG. 10 is a perspective view of the combination of the multi-layer bamboo slats of the invention with other kind of bamboo slats by tongue and groove joints according to the process of the present invention.
Figure 11:
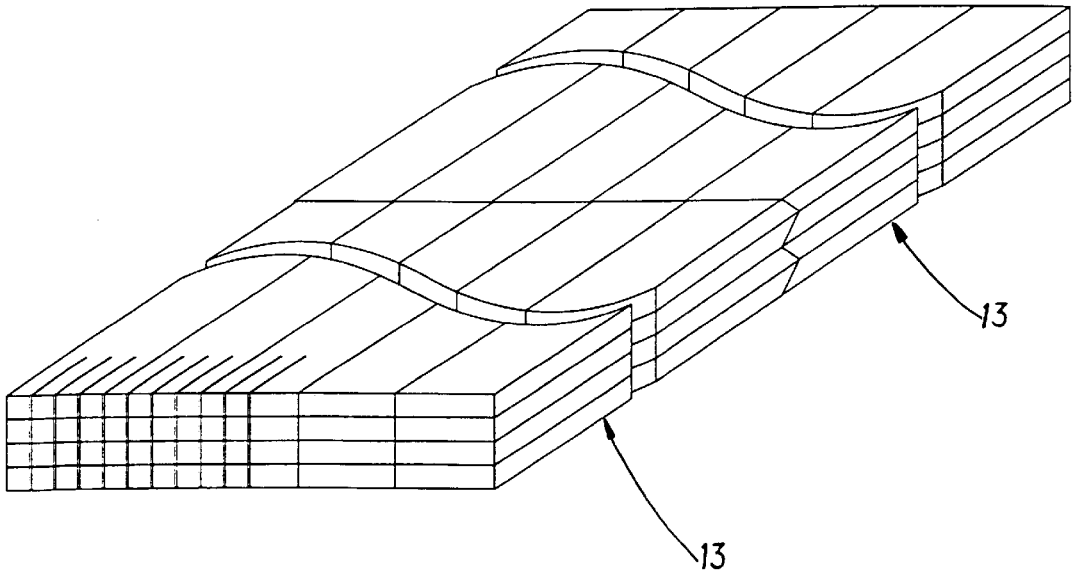
FIG. 11 is a perspective view of slices of the bamboo slats combined by tongue and groove joints.

Furthermore, with referring to FIGS. 10 and 11, it is shown that the multi-layer bamboo plate with a predetermined size (13) can be combined with other multi-layer plates of the same size (13) by tongue and groove joints and become extended plates, which can be cut into longer slats suitable for making larger window shades with a size of 8 feet or 10 feet in length, or doors or window frames.

What is claimed is:

1. A method of manufacturing bamboo slats of bamboo blinds comprising the steps of:

slicing bamboos into 7 to 12 pieces of bamboo strips, each having a width of 18–27 mm, then peeling off barks and joints of the bamboo strips and smoothing the bamboo strips so that each of the bamboo strips having a thickness from 6 mm to 8 mm and a width of 16 mm to 24 mm;

steaming the bamboo strips in a container with high pressure and high heat through 10–120 minutes for removing sugars contained in the bamboo strips: then boiling them in a boiler filled with water containing 0.3%–0.8% of NaOH for a predetermined time period, and then taking the bamboo strips out of the boiler and washing the bamboo strips; then, putting the bamboo strips to the boiler with solution of anti-insects boride and bleach detergent and boiling the bamboo strips for 2–5 hours;

drying the steamed and boiled bamboo strips at a temperature of about 40–60° C. and making sure that the water in the bamboo strips is effectively reduced to be between 5–10% and hardness of the bamboo strips is upgraded as well;

smoothing the dried bamboo strips on the whole surface for forming oblong bamboo strips having a thickness of about 4.5–7 mm and a width of about 15–21 mm;

assembling a plurality of smoothed bamboo strips into a bamboo plate having a thickness of about 4.5–7 m/m and then sanding the two sides of the bamboo plates; then, applying adhesive to gaps between the bamboo plates and pressing the bamboo plate in a pressing machine under high temperature and high heat so as to form a multi-layer bamboo plate set having the thickness of 15–45 mm; and cutting vertically the multi-layer bamboo plate set into bamboo slats of a predetermined size with a thickness of 3 mm and then performing the processes of anti-moisture and anti-insects polish or wax surfaces of the bamboo slats.

* * * * *